US007120578B2

(12) United States Patent
Thyssen et al.

(10) Patent No.: US 7,120,578 B2
(45) Date of Patent: Oct. 10, 2006

(54) SILENCE DESCRIPTION CODING FOR MULTI-RATE SPEECH CODECS

(75) Inventors: Jes Thyssen, Laguna Niguel, CA (US); Huan-yu Su, San Clemente, CA (US); Adil Benyassine, Irvine, CA (US); Eyal Shlomot, Irvine, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 752 days.

(21) Appl. No.: 09/841,764

(22) Filed: Apr. 24, 2001

(65) Prior Publication Data

US 2001/0016811 A1 Aug. 23, 2001

Related U.S. Application Data

(63) Continuation of application No. 09/200,624, filed on Nov. 30, 1998, now Pat. No. 6,256,606.

(51) Int. Cl.
*G10L 11/06* (2006.01)
*G10L 19/12* (2006.01)

(52) U.S. Cl. ..... 704/221; 704/210; 704/208

(58) Field of Classification Search ..... 704/201–501
See application file for complete search history.

(56) References Cited

U.S. PATENT DOCUMENTS 5,546,395 A 8/1996 Sharma et al.
5,553,243 A 9/1996 Harrison et al.
5,592,586 A 1/1997 Maitra et al.
5,630,016 A * 5/1997 Swaminathan et al. ..... 704/214
5,632,005 A 5/1997 Davis et al.
5,687,184 A 11/1997 Lorenz et al.
5,742,930 A * 4/1998 Howitt ..... 704/214
5,778,338 A 7/1998 Jacobs et al.
5,812,965 A 9/1998 Massaloux (Continued)

FOREIGN PATENT DOCUMENTS

EP O680034 A1 4/1995

(Continued)

OTHER PUBLICATIONS

Mano et al ("Design of a Pitch Synchronous Innovation CELP Coder for Mobile Communications", IEEE Journal on Selected Areas in Communications, pp.: 31-41, Jan. 1995).*

(Continued)

*Primary Examiner*—Angela Armstrong
(74) *Attorney, Agent, or Firm*—Farjami & Farjami LLP

(57) ABSTRACT

Speech coding systems include multi-rate speech codecs having an encoder and a decoder. Silence description coding for multi-rate speech coding systems that employ discontinued transmission is performed in either the encoder or the decoder of the multi-rate speech codec. It may also be performed in a distributed manner wherein it is performed partially in the encoder and partially in the decoder. The silence description coding is performed on a speech signal having a substantially non-speech-like characteristic. Voice activity detection classifies the speech signal as being either substantially speech-like or substantially non-speech-like. The silence description coding is selected from a plurality of coding modes. In certain embodiments of the invention, the silence description coding is a source coding mode that operates at a bit rate that fits within a bit rate budget as determined by all of the available source coding modes within the plurality of coding modes. The silence description coding is also accompanied with signaling coding and channel coding of the speech signal. Error checking is performed using an unused portion of a bandwidth of the multi-rate speech codec's bit rate. This error checking involves majority voting in certain embodiments of the invention.

32 Claims, 9 Drawing Sheets

U.S. PATENT DOCUMENTS

| | | | | |
|---|---|---|---|---|
| 5,978,761 | A * | 11/1999 | Johansson | 704/226 |
| 6,029,127 | A * | 2/2000 | Delargy et al. | 704/215 |
| 6,182,032 | B1 * | 1/2001 | Rapeli | 704/214 |
| 6,256,606 | B1 * | 7/2001 | Thyssen et al. | 704/221 |

FOREIGN PATENT DOCUMENTS

| | | |
|---|---|---|
| WO | WO92/22891 | 12/1992 |
| WO | WO98/15946 | 4/1998 |

OTHER PUBLICATIONS

Caire et al ("CDMA System Design through Asymptotic Analysis", Global Telecommunications Conference, pp. 2456-2460 vol. 5, Dec. 5-9, 1999).*

Iacovo et al ("Vector Quantization and Perceptual Criteria in SVD Based CELP Coders", 1990 International Conference on Acoustics, Speech, and Signal Processing, pp. 33-36 vol. 1, Apr. 3-6, 1990).*

Reibman et al. (A. Reibman & W. Nolte, "Optimal Fault-Tolerant Signal Detection," IEEE Transactions on Acoustics, Speech & Signal Processing, Jan. 1990).

Erdal Paksoy, Krishnaswamy Srinivasan, and Allen Gersho, "Variable Bit-Rate CELP Coding of Speech with Phonetic Classification," European Transactions on Telecommunications and Related Technologies, vol. 5, No. 5, Sep./Oct. 1994, pp. 57/591-67/601.

Dellaert et al. (F. Dellaert, T. Polzin, & A. Waibel, "Recognizing Emotion in Speech," International Conference on Spoken Language Proceedings, Oct. 1996).

Adil Benyassine, et al., "ITU-T Recommendation G.729 Annex B A Silence Compression Scheme for Use with G.729 Optimized for V.70 Digital Simultaneous Voice and Data Applications," IEEE Communications Magazine, Sep. 1997, pp. 64-73.

* cited by examiner

SILENCE DESCRIPTION CODING FOR MULTI-RATE SPEECH CODECS

This application is a continuation of number 09/200,624, filed Nov. 30, 1998, now U.S. Pat. No. 6,256,606 which is hereby incorporated by reference herein.

BACKGROUND

1. Technical Field

The present invention relates generally to speech coding using a speech codec; and, more particularly, it relates to silence description coding for multi-rate speech codecs.

2. Description of Prior Art

Conventional speech codec systems that employ silence description coding typically employ some type of voice activity detection algorithm that determines the existence of a substantially speech-like signal contained within a speech signal. When no voice activity is detected in the speech signal, the conventional speech codec utilizes a reduced data transmission rate. In addition, in conventional speech codecs that employ discontinued transmission, operation at a full data transmission rate is performed only when there is an existence of the substantially speech-like signal contained within the speech signal.

A common approach to performing data transmission at the reduced rate, particularly within conventional speech codec systems that operate at multiple data transmission rates, is to employ a fixed reduced rate for each of a multiple data transmission rates. For example, a first reduced data transmission rate accompanies the highest of the multiple data transmission rates. A second reduced data transmission rate accompanies the lowest of the multiple data transmission rates. This convention solution of dedicating a separate reduced data transmission rate for each of the multiple data transmission rates results in gross over-allocation of encoder processing resources in the conventional speech codec, in that, more processing circuitry is required to accommodate each of the reduced data transmission rates. Additionally, it creates a computational complexity associated with the need to have a dedicated reduced data transmission rate for each of the multiple data transmission rates.

Another limitation associated with the conventional solution of having a separate reduced data transmission rate for each of the multiple data transmission rates is the intrinsic limitation of bandwidth available within any communication system. Inefficient allocation and management of the available bandwidth in the communication system provides undesirable limitations on the number of communication devices that may be employed at any given time. Additionally, the inefficient use of the available bandwidth precludes efficient use of the remaining bandwidth for other functions not associated exclusively with data transmission. In many conventional speech codec systems, the entire bandwidth spectrum is consumed, and there simply is no available remaining bandwidth in which to perform the other functions.

The traditional solution of detecting the existence of the substantially speech-like signal contained within a speech signal and adjusting the data transmission rate as a function of the substantially speech-like signal typically performs encoding and transmission of all speech segments. The encoding and transmission of all speech segments includes those speech segments that do not contain the substantially speech-like signal. This results in very inefficient allocation of the speech codec's processing resources, in that, every speech segment is encoded even in the absence of the substantially speech-like signal. Operation at the reduced data transmission rate typically involves transmitting a subset of parameters that the speech codec uses to encode the speech signal. The subset of parameters is typically transmitted only when there is a perceptual change in the substantially non-speech-like speech signal.

Other conventional speech codec systems discontinue data transmission altogether in the absence of the substantially speech-like signal. In these conventional speech codec systems, a voice activity detection algorithm is implemented that determines the existence of the substantially speech-like signal and simply discontinues data transmission when it is absent. Such systems suffer from the undesirable perceptual effect of apparent disconnection of the communication link, in that, the silence associated with no data transmission at all gives the listener the impression that no one is on the other end. This undesirable impression of disconnection of the communication link generated from interrupted data transmission greatly reduces the perceptual performance of such conventional speech codec systems. The conventional solution to generate the impression that another individual is on the other end involves performing comfort noise generation. Comfort noise generation is a specific mode of discontinued transmission wherein only a small number of speech parameters are transmitted from an encoder to a decoder in a speech codec, and intermediary values between the small number of speech parameters are generated via interpolation. The entirety of the speech parameters (including the interpolated values) are used to produce a reproduced non-speech signal that is perceptually indistinguishable from background noise. This solution of comfort noise generation provides the perceptual effect of background noise.

Further limitations and disadvantages of conventional and traditional systems will become apparent to one of skill in the art after reviewing the remainder of the present application with reference to the drawings.

SUMMARY OF THE INVENTION

Various aspects of the present invention can be found in a multi-rate speech codec that performs discontinued transmission. Specifically within the discontinued transmission, silence description coding of a speech signal is performed using a single silence description coding scheme independent of past, present, and future coding schemes that are employed to various portions of the speech signal. The speech signal has varying characteristics, and at least one of the varying characteristics is sometimes a substantially speech-like characteristic. The identification of the substantially speech-like characteristic is performed using voice detection circuitry. When there is an absence of the substantially speech-like characteristic in the speech signal, processing circuitry applies a predetermined coding mode to the speech signal independent of past, present, and future coding schemes. The predetermined coding mode is selected from among a plurality of coding modes.

In certain embodiments of the invention, the discontinued transmission involves voice activity detection, silence description coding, and comfort noise generation. The voice activity detection is performed in an encoder of the multi-rate speech codec that determines the existence of a substantially speech-like characteristic in the speech signal. The voice activity detection also detects a change in the perceptual characteristic of the speech signal. The silence description coding is also performed in the encoder wherein a small number of parameters used to code the speech signal are then transmitted to the decoder. The decoder performs the comfort noise generation to generate a non-speech-like signal that is perceptually indistinguishable from the speech signal. The silence description coding is performed to speech signals not having a substantially speech-like characteristic independent of past, present, and future coding schemes.

In certain embodiments of the invention, the predetermined coding mode fits within a predetermined bit rate budget. The predetermined bit rate budget is determined from the particular bit rate at which the multi-rate speech codec is operating. In other embodiments of the invention, the predetermined coding mode is a source coding mode that operates at a bit rate that is the lowest bit rate of all the source coding modes contained within the plurality of coding modes. Signaling coding and channel coding are also performed by the multi-rate speech codec in coding the speech signal. The multi-rate speech codes performs error checking within an unused portion of a bandwidth of the multi-rate speech codec's bit rate. This error checking involves majority voting in certain embodiments of the invention.

Other aspects, advantages and novel features of the present invention will become apparent from the following detailed description of the invention when considered in conjunction with the accompanying drawings.

DETAILED DESCRIPTION OF DRAWINGS

Figure 1:
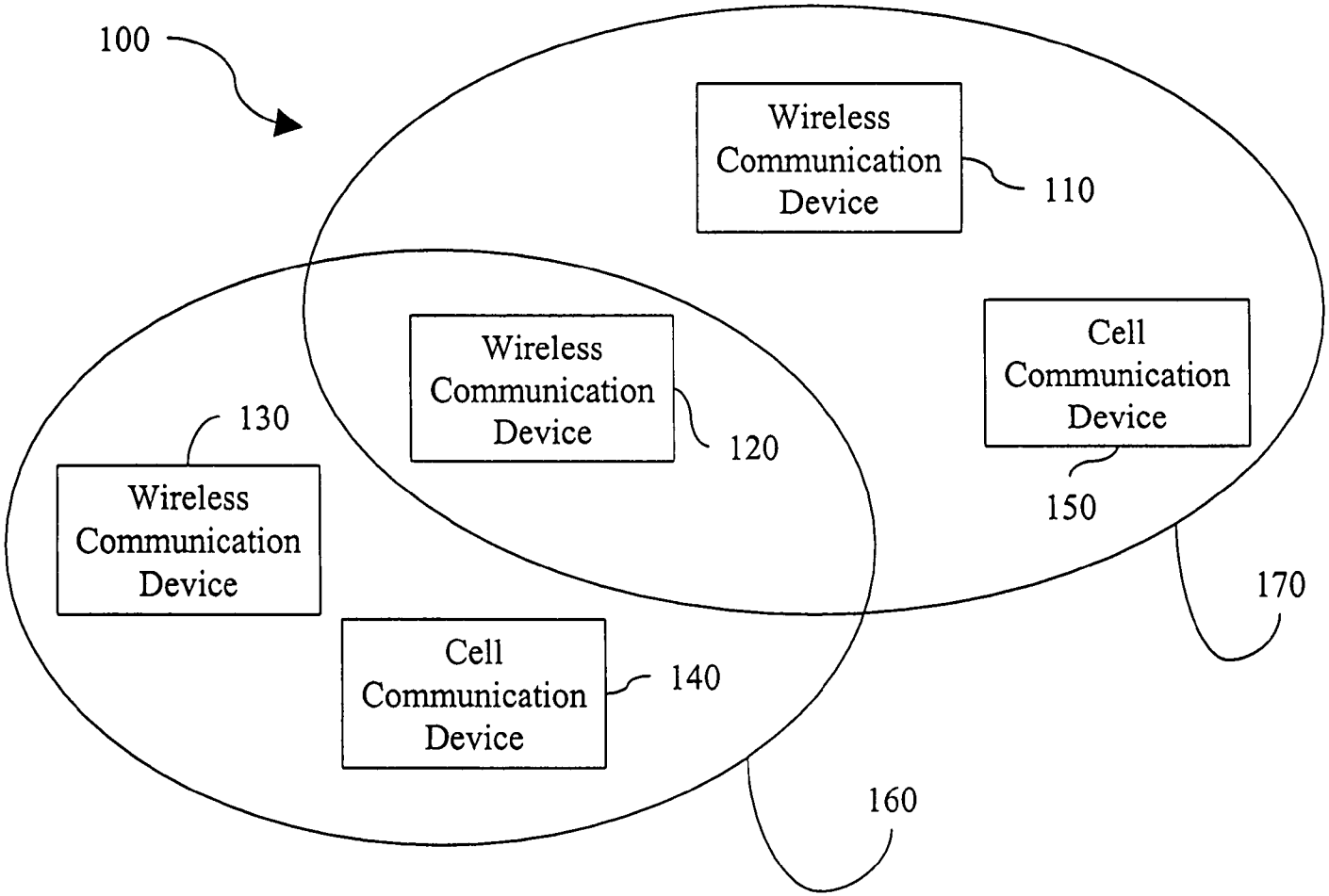
FIG. 1 is a system diagram illustrating an embodiment of a wireless data communication system built in accordance with the present invention.

FIG. 1 is a system diagram illustrating an embodiment of a wireless data communication system 100 built in accordance with the present invention. The wireless data communication system 100 contains two separate communication cells 160 and 170. In communication cell 160, there is a cell communication device 140; in communication cell 170, there is a cell communication device 150. The cell communication devices 140 and 150 serve to control the transmission of data to and from individual wireless communication devices within their respective cells. Wireless communication device 130 is in signal communication with cell communication 140 within communication cell 160. Similarly, wireless communication device 110 is in signal communication with the communication cell device 150 within communication cell 170. In wireless data communication systems similar to the wireless data communication system 100, there is often a spatial overlap between communication cells 160 and 170 wherein a wireless communication device 120 is handed off between the cell communication device 150 and the cell communication device 140. This spatial overlap serves to provide continuous service to a user of wireless communication device 120 when he is traveling between the communication cells 160 and 170. Alternatively, the spatial overlap serves to ensure a high perceptual quality of data transmission to the wireless communication device 120 from either the cell communication device 150 and the cell communication device 140, depending on which may provide better data transmission.

Inherent to the design of the communication cells 160 and 170, there is a limited amount of bandwidth available in which each cell communication device 140 and 150 can communicate with the wireless communication devices 110, 120, and 130. Also, given the intrinsic complexity of any data communication system that handles the communication between a plurality of communication devices, to accommodate a larger number of communication devices, i.e. a larger plurality, either a broader amount of bandwidth must be dedicated to the data communication system or a more elegant method of data transfer between the devices must be performed. The more elegant and advanced the method, the greater the processing requirements, unless there is some intelligent manner of conserving the available data transmission bandwidth.

The wireless data communication system 100, as implemented in accordance with the present invention, performs silence description coding for each of the wireless communication devices 110, 120, and 130 to provide efficient allocation of processing resources of the cell communication devices 140 and 150. The wireless data communication system 100 is, in one embodiment, a multi-rate speech codec that switches between various data transmission rates available to the wireless communication devices 110, 120, and 130.

Discontinued transmission is performed within the wireless data communication system 100 when voice activity detection circuit (not shown) detects the absence of a substantially voice-like characteristic in a speech signal. Silence description coding is performed to code those portions of the speech signal that the voice activity detection circuit classifies as having a substantially non-voice-like characteristic. The silence description coding is applied using a data transmission bit rate that fits within a predetermined budget as governed by available data transmission rates within the multi-rate speech codec. In addition, the silence description coding is performed independent of past, present, and future coding schemes that are employed to various portions of the speech signal. That is to say, the silence description coding that is applied to a particular portion of the speech signal having a substantially non-voice-like characteristic is not coupled to the silence description coding that is applied to other portions of the speech signal. In certain embodiments of the invention, the data transmission bit rate that fits within a predetermined budget is the lowest data transmission rate within the multi-rate speech codec.

By operating at the lowest data transmission rate within the multi-rate speech codec, the wireless data communication system 100 serves to reduce erroneous data transmission by transmitting redundant data and performing majority voting in certain embodiments of the invention. The use of the lowest data transmission rate enables the use of the remaining bandwidth of the wireless data communication system 100 to perform error checking within the silence description coding. Such redundancy and error checking serve to compensate for electromagnetic interference and radio frequency interference, common to conventional wireless data communication systems, that typically results in either erroneous data transmission or a degraded perceptual quality of the data. Additionally, by ensuring proper data transmission using the redundancy and error checking, power may be conserved, in that, large segments of data need not be resent and repeated as errors are avoided during data transmission within the wireless data communication system 100.

Figure 2:
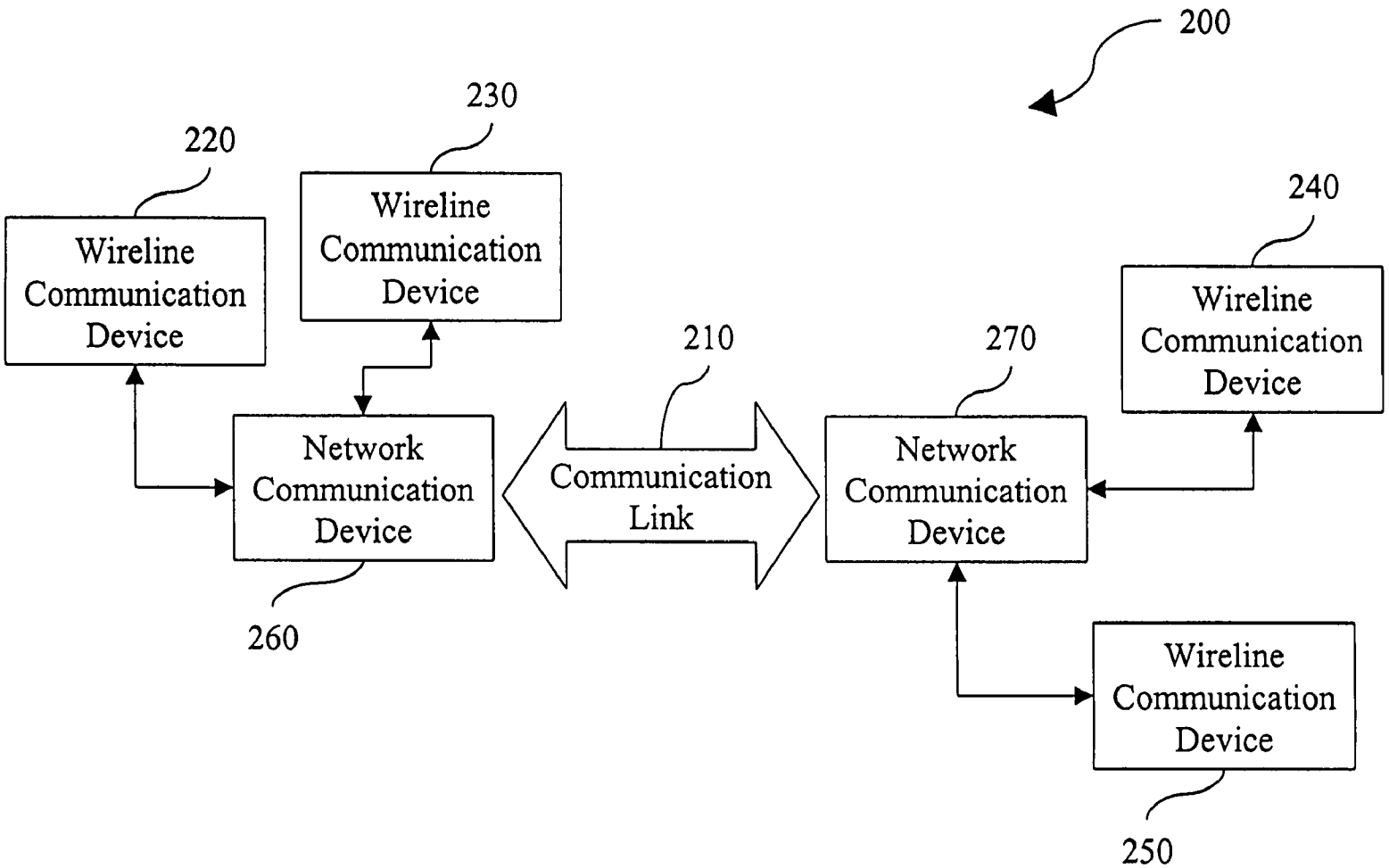
FIG. 2 is a system diagram illustrating an embodiment of a wireline data communication system built in accordance with the present invention.

FIG. 2 is a system diagram illustrating an embodiment of a wireline data communication system 200 built in accordance with the present invention. The wireline data communication system 200 has at least two network communication devices 260 and 270 that communicate with each other via a communication link 210. The network communication device 260 controls the transmission of data to and from wireline communication devices 220 and 230. Similarly, the network communication device 270 controls the transmission of data to and from wireline communication devices 240 and 250. The network communication device 260 controls the data transmission between both the wireline communication devices 220 and 230 with the wireline communication devices 240 and 250 using the network communication device 270 and the communication link 210. Any of the wireline communication devices 220, 230, 240, and 250 may communicate with each other within the wireline data communication system 200.

In certain embodiments of the invention, the network communication devices 260 and 270 serve to interface various local area networks with a network. The wireline communication devices 220 and 230 form a first local area network, and the wireline communication devices 240 and 250 form a second local area network. Each of the first and the second local area networks interface with a network formed by the network communication devices 260 and 270 connected via the communication link 210.

Similar to the wireless data communication system 100, the wireline data communication system 200 suffers from an inherently limited amount of bandwidth available in which each network communication device 260 and 270 can communicate with the wireline communication devices 220, 230, 240 and 250. In order to accommodate a larger number of wireline communication devices within each of the local area networks, either a data transmission media having a larger bandwidth must be employed, i.e. fiber optic cable as opposed to coaxial twisted pair, or a more efficient manner of data transfer between the devices must be performed.

In certain embodiments of the invention, the wireline data communication system 200, as implemented in accordance with the present invention, performs silence description coding for each of the wireline communication devices 220, 230, 240 and 250 to provide efficient allocation of processing resources of the network communication devices 260 and 270. The wireline data communication system 200 is, in one embodiment, a multi-rate speech codec that switches between various data transmission rates available to the wireline communication devices 220, 230, 240 and 250.

Discontinued transmission is performed within the wireline data communication system 200 when voice activity detection circuit (not shown) detects the absence of a substantially voice-like characteristic in a speech signal. Similar to the wireless data communication system 100 of FIG. 1, silence description coding is performed to code those portions of the speech signal that the voice activity detection circuit classifies as having a substantially non-voice-like characteristic. The silence description coding is applied using a data transmission bit rate that fits within a predetermined budget as governed by available data transmission rates of the multi-rate speech codec. In addition, the silence description coding is performed independent of past, present, and future coding schemes that are employed to various portions of the speech signal. In certain embodiments of the invention, the data transmission bit rate that fits within the predetermined budget is the lowest data transmission rate within the multi-rate speech codec.

Silence description coding is applied to the lowest data transmission rate within the multi-rate speech codec. Similar to the embodiment of the wireless data communication system 100 of FIG. 1 that employs silence description coding, the wireline data communication system 200, in performing silence description coding, operates at the lowest data transmission rate provides opportunity for redundancy and error checking. Such operations serve to provide efficient allocation of the bit rate of the wireline data communication system 200.

Figure 3:
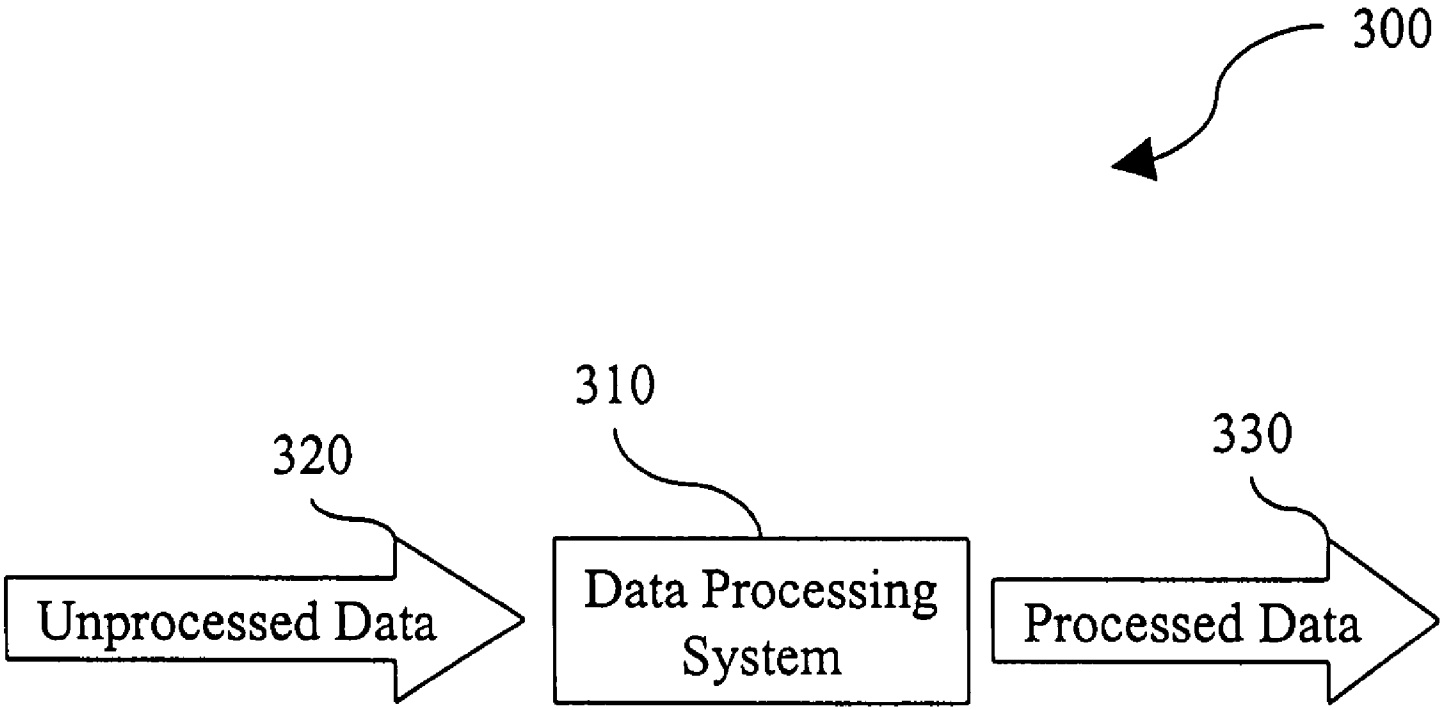
FIG. 3 is a system diagram illustrating an embodiment of a data processing system built in accordance with the present invention.

FIG. 3 is a system diagram illustrating an embodiment 300 of a data processing system 310 built in accordance with the present invention. The data processing system 310 receives a plurality of unprocessed data 320 and produces a plurality of processed data 330.

In certain embodiments of the invention, the data processing system 310 is processing circuitry that performs the loading of the plurality of unprocessed data 320 into a memory from which selected portions of the plurality of unprocessed data 320 are processed in a sequential manner. The processing circuitry possesses insufficient processing capability to handle the entirety of the plurality of unprocessed data 320 at a single, given time. The processing circuitry may employ any method known in the art that transfers data from a memory for processing and returns the plurality of processed data 330 to the memory.

In certain embodiments of the invention, the data processing system 310 is a system that converts a speech signal into encoded speech data. The encoded speech data may then be used to generate a reproduced speech signal perceptually indistinguishable from the speech signal using speech reproduction circuitry. In other embodiments of the invention, the data processing system 310 is a system that converts encoded speech data, represented as the plurality of unprocessed data 320, into the reproduced speech signal, represented as the plurality of processed data 330. In other embodiments of the invention, the data processing system 310 converts encoded speech data that is already in a form suitable for generating a reproduced speech signal perceptually indistinguishable from the speech signal, yet additional processing is performed to improve the perceptual quality of the encoded speech data for reproduction.

The data processing system 310 is, in one embodiment, a system that performs silence description coding and selects the lowest available data transmission rate in accordance with the embodiments described in FIGS. 1 and 2. The data processing system 310 operates to convert a plurality of unprocessed data 320 into a plurality of processed data 330. The conversion performed by the data processing system 310 may be viewed as taking place at any interface wherein data must be converted from one form to another, i.e. from speech data to coded speech data, from coded data to a reproduced speech signal, etc.

Figure 4:
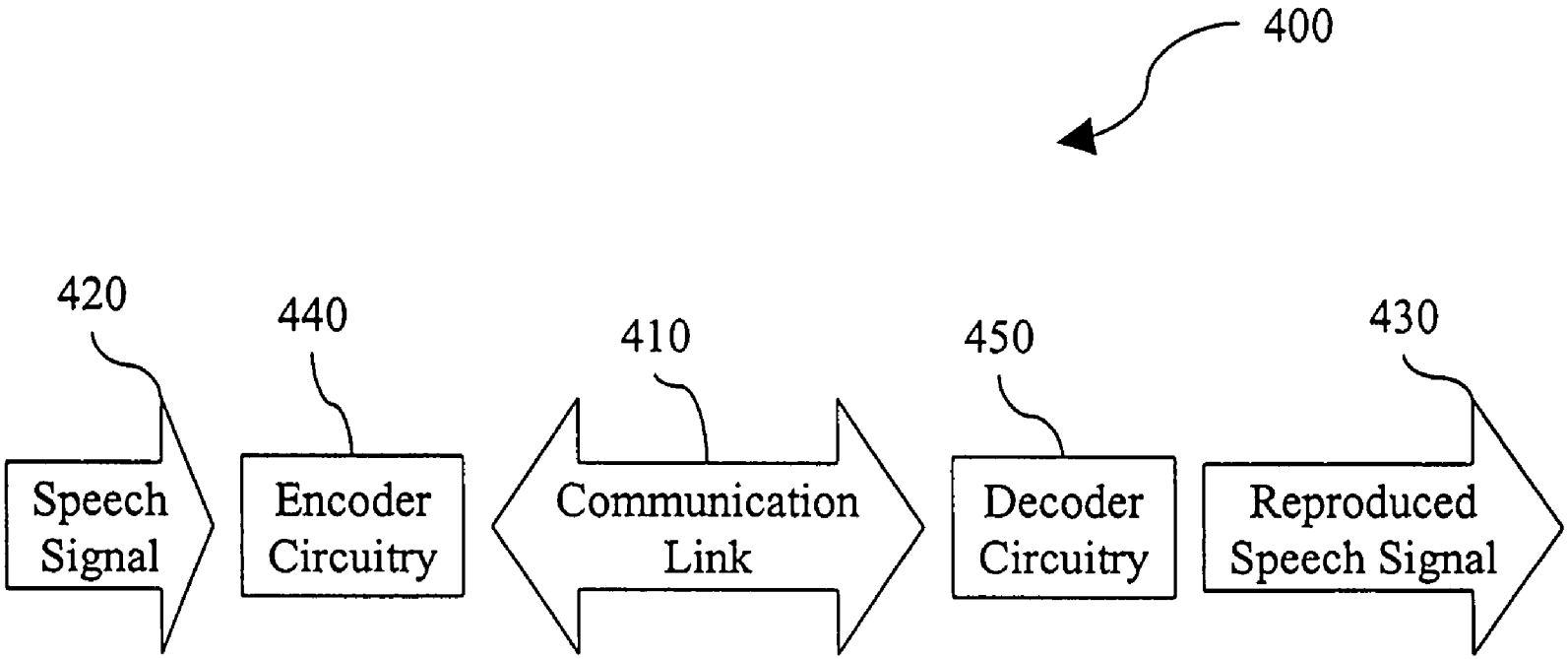
FIG. 4 is a system diagram illustrating an embodiment of a speech codec built in accordance with the present invention that communicates across a communication link.

FIG. 4 is a system diagram illustrating an embodiment of a speech codec 400 built in accordance with the present invention that communicates across a communication link 410. A speech signal 420 is input into an encoder processing circuit 440 in which it is coded for data transmission via the communication link 410 to a decoder processing circuit 450. The decoder processing circuit 450 converts the coded data to generate a reproduced speech signal 430 that is substantially perceptually indistinguishable from the speech signal 420.

In certain embodiments of the invention, the decoder processing circuit 450 includes speech reproduction circuitry (not shown). Similarly, the encoder processing circuit 440 includes selection circuitry (not shown) that selects from a plurality of coding modes (not shown). The communication link 410 may be either a wireless or a wireline communication link without departing from the scope and spirit of the invention. The encoder processing circuit 440 identifies at least one perceptual characteristic of the speech signal and selects an appropriate silence description coding scheme depending on the identified perceptual characteristics of a speech signal. The at least one perceptual characteristic is a substantially speech-like signal in certain embodiments of the invention.

The speech codec 400 is, in one embodiment, a multi-rate speech codec that performs silence description coding to the speech signal 420 using the encoder processing circuit 440 and the decoder processing circuit 450. The silence description coding involves selecting the lowest data transmission rate within the multi-rate speech codec as described in the embodiments of FIGS. 1, 2, and 3.

Figure 5:
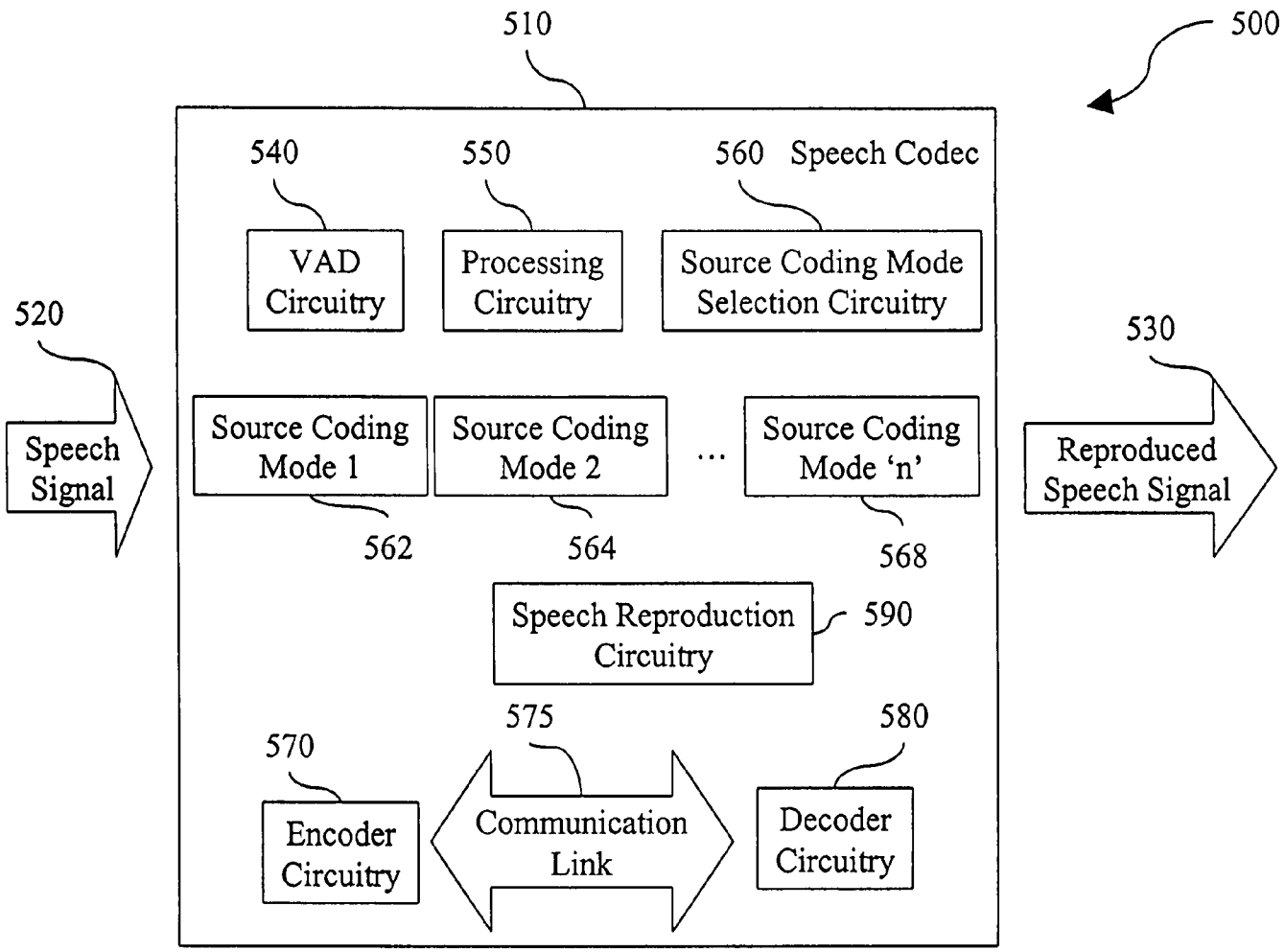
FIG. 5 is a system diagram illustrating a specific embodiment of a speech codec built in accordance with the present invention that selects from among a plurality of source coding modes.

FIG. 5 is a system diagram illustrating a specific embodiment 500 of a speech codec 510 built in accordance with the present invention that selects from among a plurality of source coding modes (shown collectively by blocks 562, 564, and 568) using a source coding mode selection circuit 560. The speech codec 510 contains an encoder circuit 570 and a decoder circuit 580 that communicate via a communication link 575. The speech codec 510 takes in a speech signal 520 and identifies an existence of a substantially speech-like signal using a voice activity detection circuit 540. The source coding mode selection circuit 560 uses the detection of the substantially speech-like signal in selecting which source coding mode to employ in coding the speech signal using the encoder circuit 570. The speech codec 510 may also detect other perceptual characteristics of the speech signal 520 using a processing circuit 550 to assist in coding of the speech signal using the encoder circuit 570. The coding of the speech signal includes source coding, signaling coding, and channel coding for transmission across the communication link 575. After the speech signal 520 has been coded and transmitted across the communication link 575, and it is received at the decoder circuit 580, a speech reproduction circuit 590 serves to generate a reproduced speech signal 530 that is substantially perceptually indistinguishable from the speech signal 520.

The speech codes 510 is, in one embodiment, a multi-rate speech codec that performs silence description coding to the speech signal 520 using the encoder processing circuit 570 and the decoder processing circuit 580. The silence description coding involves detecting the absence of a substantially speech-like signal in the speech signal 520 using the voice activity detection circuit 540 and selecting the lowest data transmission rate within the multi-rate speech codec as described in the embodiments of FIGS. 1, 2, 3 and 4. The lowest data transmission rate is one of the source coding modes (shown collectively by blocks 562, 564, and 568) that is selected using the source coding mode selection circuit 560. As described in the embodiments above, the communication link 575 may be either a wireless or a wireline communication link without departing from the scope and spirit of the invention.

Figure 6:
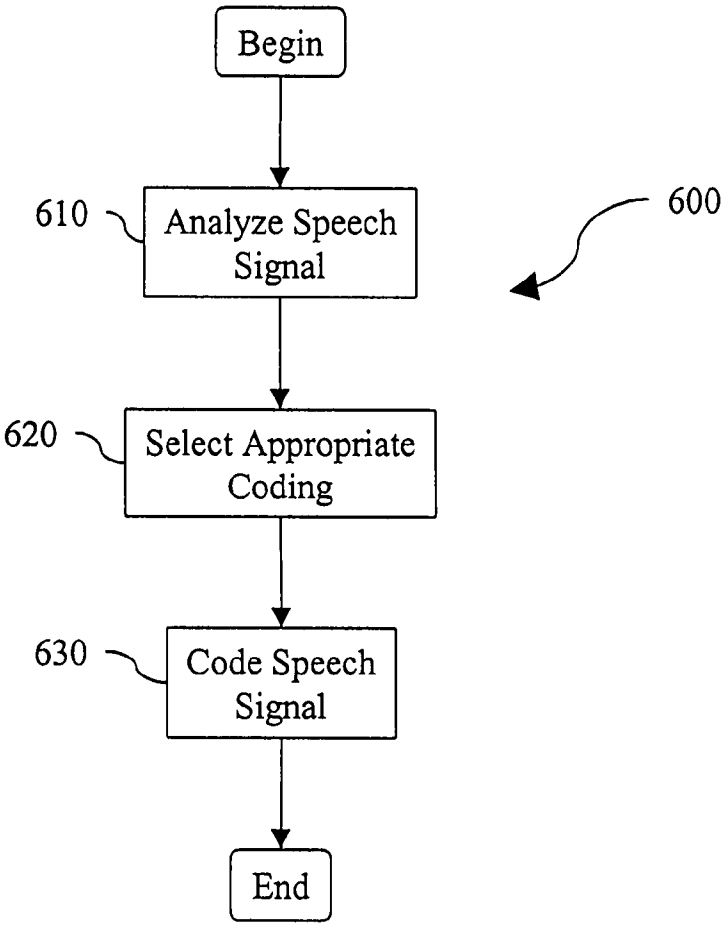
FIG. 6 is a functional block diagram illustrating a speech coding method performed in accordance with the present invention.

FIG. 6 is a functional block diagram illustrating a speech coding method 600 performed in accordance with the present invention. The speech coding method 600 selects an appropriate coding scheme depending on the identified perceptual characteristics of a speech signal. At a block 610, a speech signal is analyzed to identify at least one perceptual characteristic. Examples of perceptual characteristics include pitch, intensity, periodicity, a substantially speech-like signal, or other characteristics familiar to those having skill in the art of speech processing. At a block 620, the at least one perceptual characteristic that was identified in the block 610 is used to select an appropriate coding scheme for the speech signal. In a block 630, the coding scheme parameters that were selected in the block 620 are used to code the speech signal.

The speech coding includes source coding, signaling coding, and channel coding in certain embodiments of the invention. The speech coding method 600 is silence description coding that is performed within a multi-rate speech codec wherein the scheme parameters are transmitted from an encoder to a decoder. The coding parameters may be transmitted from the cell communication device 150 (FIG. 1) across a wireless communication channel (FIG. 1, not shown) whereupon the coding parameters are delivered to the wireless communication device 110 (FIG. 1). Alternatively, the coding parameters may be transmitted across any communication medium. For example, the coding parameters may be transmitted from the network communication device 260 (FIG. 2) across the communication link 210 (FIG. 2) whereupon the coding parameters are delivered to network communication device 270 (FIG. 2).

Figure 7:
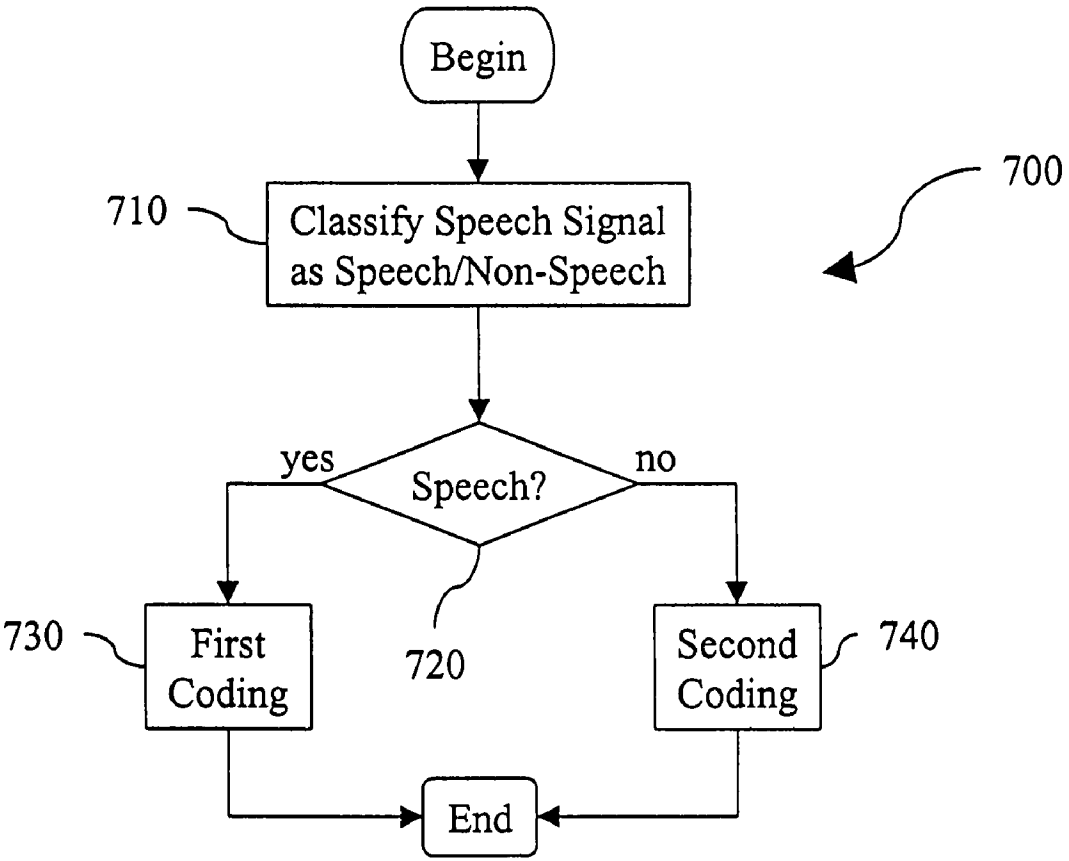
FIG. 7 is a functional block diagram illustrating a speech coding method performed in accordance with the present invention that selects from among a first coding scheme and a second coding scheme.

FIG. 7 is a functional block diagram illustrating a speech coding method 700 performed in accordance with the present invention that selects from among a first coding scheme 730 and a second coding scheme 740. In particular, FIG. 7 illustrates a speech coding method 700 that classifies a speech signal as having either a substantially speech-like characteristic or a substantially non-speech-like characteristic in a block 710. Depending upon the classification performed in the block 710, one of either the first coding scheme 730 or the second coding scheme 740 is used to code the speech signal. More than two coding schemes may be included in the present invention without departing from the scope and spirit of the invention. Selecting between various coding schemes may be performed using a decision block 720 in which the existence of a substantially speech-like signal, as determined by using a voice activity detection circuit such as the voice activity detection circuit 540 of FIG. 5, serves to classify the speech signal as either having the substantially speech-like characteristic or the substantially non-speech-like characteristic. In the speech coding method 700, the classification of the speech signal as having either the substantially speech-like characteristic or the substantially non-speech-like characteristic, as determined by the block 710, serves as the primary decision criterion, as shown in the decision block 720, for performing a particular coding scheme.

In certain embodiments of the invention, the classification performed in the block 710 involves applying a weighted filter to the speech signal. Other characteristics of the speech signal are identified in addition to the existence of the substantially speech-like signal. The other characteristics include speech characteristics such as pitch, intensity, periodicity, or other characteristics familiar to those having skill in the art of speech signal processing.

Figure 8:
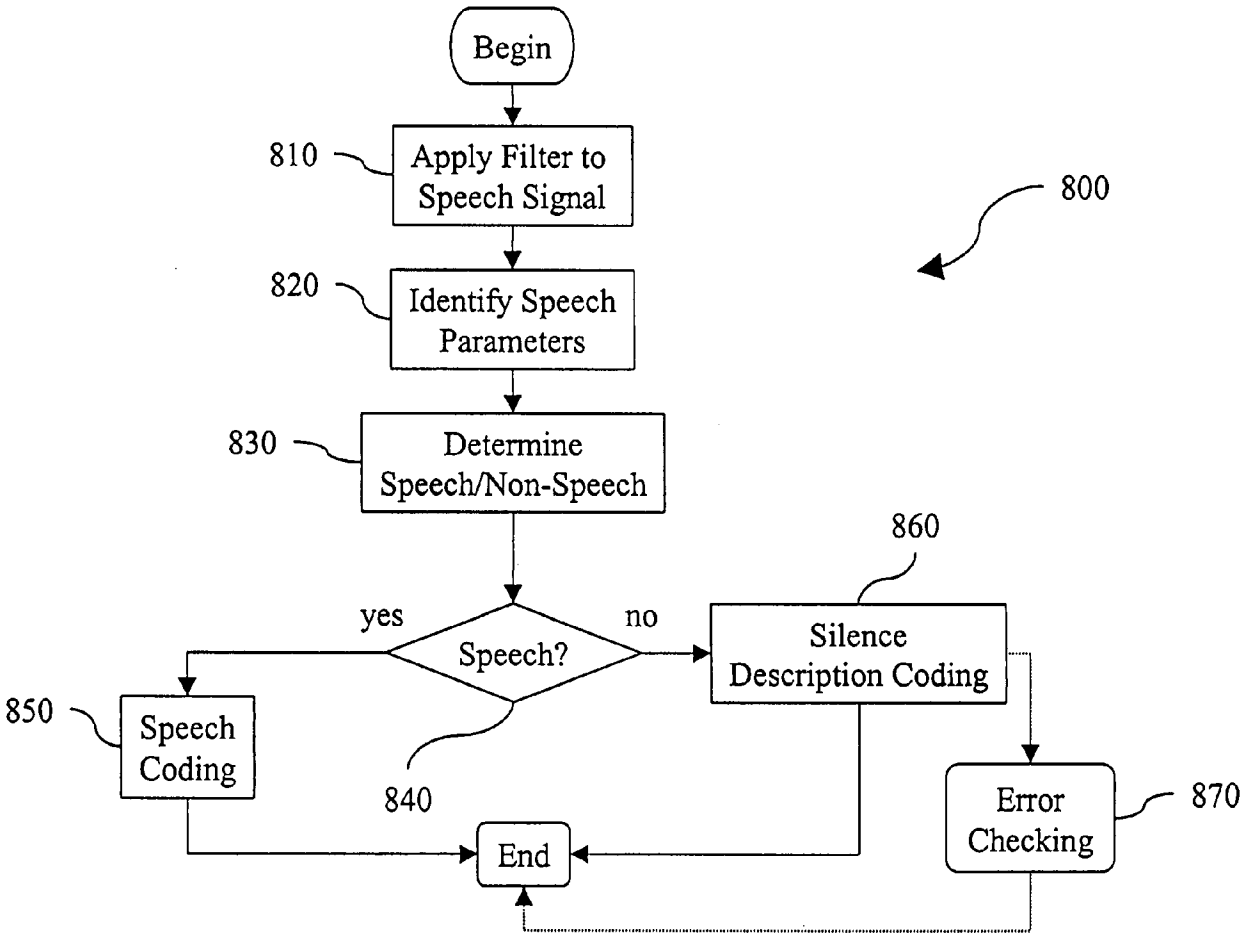
FIG. 8 is a functional block diagram illustrating a speech coding method that performs silence description coding in accordance with the present invention.

FIG. 8 is a functional block diagram illustrating a speech coding method 800 that performs silence description coding in accordance with the present invention. In a block 810, a speech signal is filtered using a weighted filter. The weighted filter may include a perceptual weighting filter or weighting filter applied to non-perceptual characteristics of the speech signal. In a block 820, speech parameters of the speech signal are identified. Such speech parameters may include speech characteristics such as pitch, intensity, periodicity, a substantially speech-like signal, or other characteristics familiar to those having skill in the art of speech signal processing.

In this particular embodiment of the invention, a block 830 determines whether the speech signal has either a substantially speech-like characteristic or a substantially non-speech-like characteristic. The block 830 uses the identified speech parameters extracted from the speech signal using the block 820. These speech parameters are processed to determine whether the speech signal has either the substantially speech-like characteristic or the substantially non-speech-like characteristic. A decision block 840 directs the speech coding method 800 to employ a speech coding, as shown in a block 850. The speech coding shown in the block 850 is applied to speech signals having a substantially speech-like signal. Alternatively, if the speech signal is found not to have a substantially speech-like signal, the speech signal is coded using silence description coding in a block 860. If desired, in an alternative block 870, error checking is performed in certain embodiments of the invention. The error checking of the alternative block 870 is the redundancy and error checking as described above that are used to ensure efficient allocation of the available bandwidth of a speech coding system, conservation of power resources, and minimization of electromagnetic interference and radio frequency interference.

Figure 9:
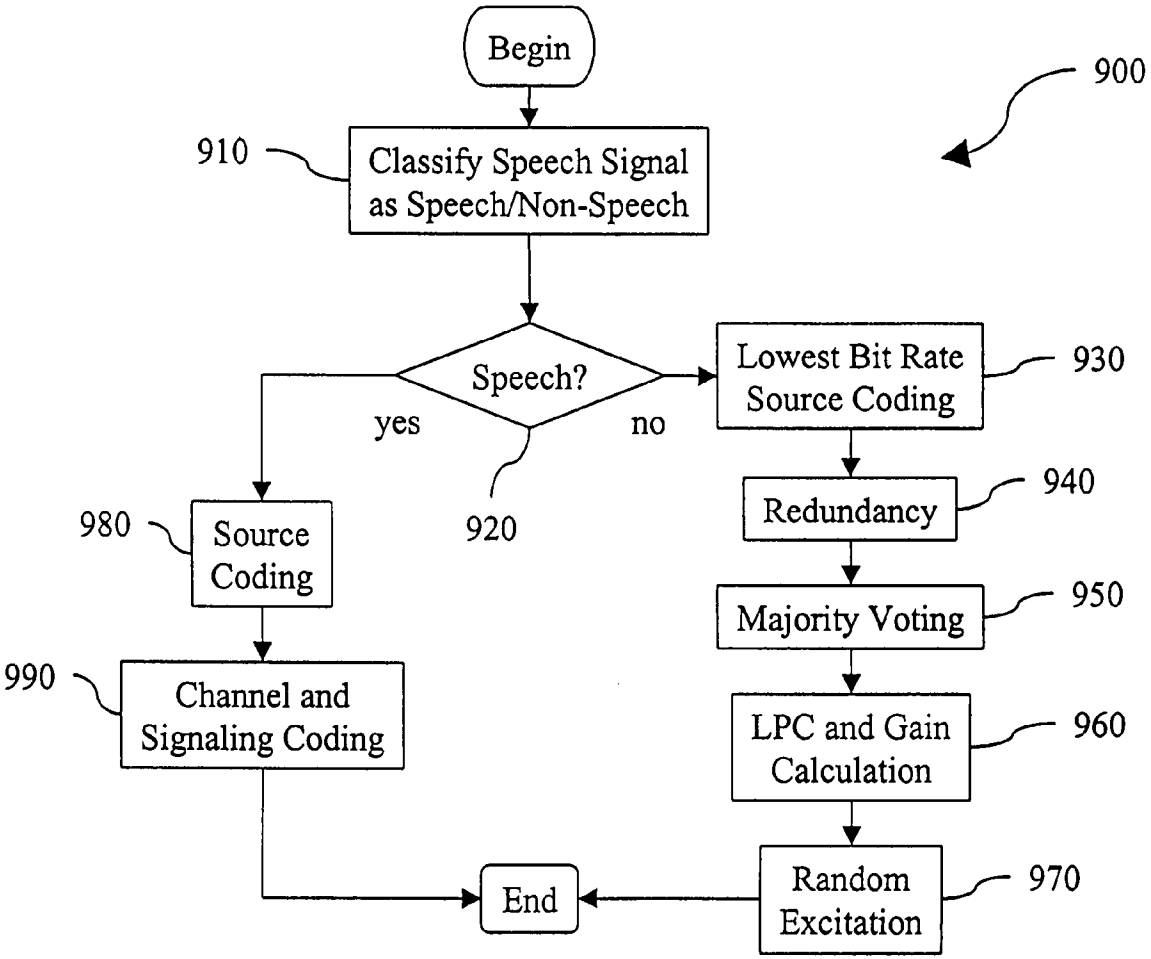
FIG. 9 is a functional block diagram illustrating a speech coding method that applies a predetermined source coding to an inactive voice speech signal in accordance with the present invention.

FIG. 9 is a functional block diagram illustrating a speech coding method 900 that applies a predetermined source coding to a speech signal having a substantially non-speech-like characteristic in accordance with the present invention. In a block 910, a speech signal is classifies as having either a substantially speech-like characteristic or a substantially non-speech-like characteristic. In a decision block 920, the speech coding method 900 selects one of two speech coding schemes depending on the classification of the speech signal as having either a substantially speech-like characteristic or a substantially non-speech-like characteristic in the block 910. If the speech signal is classified as having a substantially speech-like characteristic, then a source coding is applied to the speech signal in a block 980. Subsequently, a channel coding and a source coding are applied to the speech signal in a block 990. The speech coding shown in the blocks 980 and 990 are applied to speech signals having a substantially speech-like signal. In certain embodiments of the invention wherein the speech coding method 900 is implemented within a multi-rate speech codec as described in the various embodiments of the invention, the source coding applied in the block 980 is any one of the various data transmission rates available within the multi-rate speech codec. Similarly, the channel coding and the signaling coding employed in the block 990 uses any one of the various data transmission rates available within the multi-rate speech codec.

Alternatively, when the speech signal is classified as having a substantially non-speech-like signal, a silence description coding scheme is employed. A lowest bit rate source coding is selected in a block 930. Redundancy of the source coding is performed in a block 940. Majority voting is employed in a block 950 using the redundancy of the block 940. Linear prediction coefficients and at least one gain corresponding to the speech signal in a block 960. A random excitation is employed in a block 970 within the speech coding method 900 as performed in accordance with the present invention.

In certain embodiments of the invention, the lowest bit rate source selected in a block 930 is the lowest data transmission rate within a multi-rate speech codec as described in specific embodiments employing the multi-rate speech codec of FIGS. 1, 2, 3, 4 and 5. Regardless of the specific bit rate being employed in the multi-rate speech codec, the source coding dedicated to performing the source coding is chosen to be the lowest source coding bit rate in the block 930. In addition, the redundancy performed in the block 940 and the operation at the lowest bit rate source coding as shown in the block 930 both provide opportunity for redundancy and error checking. The redundancy of the block 940 serves to provide efficient allocation of the bit rate of either any data communication system. The majority voting in the block 950 performs a statistical analysis and calculation using the redundancy of the block 940. In certain embodiments that transmit a plurality of data bits that are repetitive, or redundant, the majority voting of 950 determines whether a majority of the repetitive data bits is the same. If they agree, then with a certain degree of confidence, the data transmission is taken to be error-free within a communication system.

In certain embodiments of the invention, the linear prediction coefficients and at least one gain corresponding to the speech signal are calculated in the block 960. The linear prediction coefficients and at least one gain are calculated using either a parametric coding scheme or a code-excited linear prediction coding scheme as known by those having skill in the art of speech signal processing. In certain embodiments of the invention as described above, the at least one gain corresponds to an energy level of the speech signal. The random excitation of the block 970 is a code-vector extracted from a randomly populated codebook. Alternatively, the random excitation of the block 970 is a randomly chosen code-vector.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A communication device having a multi-rate speech coder that performs silence description coding of a speech signal having varying characteristics, comprising:

a voice activity detection circuit that is capable of identifying a substantially speech-like characteristic of a segment of the speech signal; and a processing circuit communicatively coupled to the voice activity detection circuit, the processing circuit being capable of selectively applying one of a plurality of coding modes to the segment of the speech signal, wherein the plurality of coding modes comprises a plurality of speech coding modes and a silence description coding mode, wherein the processing circuit selects the silence description coding mode upon the identification of the absence of a substantially speech-like characteristic of the segment of the speech signal independent of the speech coding mode applied before the segment.

2. The communication device of claim 1, wherein the communication device comprises a wireless communication device.

3. The communication device of claim 2, wherein the wireless communication device comprises a telephone.

4. The communication device of claim 3, wherein the telephone comprises a cellular telephone.

5. The communication device of claim 1, wherein the communication device comprises a handheld wireless communication device.

6. The communication device of claim 1, wherein the communication device comprises a computer network-based communication device.

7. The communication device of claim 6, wherein the computer network-based communication device is capable of communicating via an internet-based network.

8. The communication device of claim 6, wherein the computer network-based communication device is capable of transmitting an encoded speech signal via the internet-based network.

9. The communication device of claim 1, wherein the communication device is capable of communicating via a computer network and telephone network.

10. The communication device of claim 9, wherein the telephone network is a cellular telephone network.

11. The communication device of claim 1, wherein the communication device comprises a data processor.

12. The communication device of claim 1, wherein the communication device comprises a network interface device that is capable of interfacing a cellular telephone to a computer network.

13. The communication device of claim 1, wherein the processing circuit selects a discontinuous transmission mode after the silence description coding mode.

14. A method of coding a speech signal, comprising:

coding a first segment of the speech signal using a speech coding mode selected from a plurality of speech coding modes; and coding a second segment of the speech signal using a silence description coding mode independent of the speech coding mode used to code the first segment of the speech signal.

15. The method of claim 14, further comprising:

transmitting the coded first and second segments of the speech signal.

16. The method of claim 15, further comprising:

transmitting an error checking signal with the coded second segment of the speech signal.

17. The method of claim 16, wherein the transmitting the error checking signal comprises transmitting redundant data.

18. A communication system, comprising:

a coder;

a decoder; and a communication network selectively interconnecting the coder and the decoder;

wherein the coder comprises a voice activity detector, a processor coupled with the voice activity detector, and a transmitter coupled with the processor, wherein the voice activity detector receives first and second segments of a speech signal and identifies a substantially speech-like characteristic of the first segments and an absence of a substantially speech-like characteristic of the second segment of the speech signal, wherein the processor selectively applies one of a plurality of coding modes to the first and second segments, the plurality of coding modes comprises a plurality of speech coding modes and a silence coding mode, wherein the processor applies the silence description coding mode to the second segment of the speech signal independent of the speech coding mode applied to the first segments of the speech signal.

19. The communication system of claim 18, wherein the decoder generates a reproduced speech signal that is substantially imperceptible from the first and second segments of the speech signal.

20. The communication system of claim 19, wherein the coder selects a discontinuous transmission mode after the silence description coding mode.

21. The communication system of claim 19, wherein the communication network comprises a wireless communication network.

22. The communication system of claim 19, wherein the communication network comprises a computer network.

23. The communication system of claim 22, wherein the computer network comprises a local area network.

24. The communication system of claim 22, wherein the communication network further comprises a wireline communication network connected with the computer network.

25. A multi-rate codec that encodes a first speech signal having a first plurality of segments and receives a second speech signal having a plurality of encoded segments, comprising:

a multi-rate coder, wherein the multi-rate coder is capable of coding each of the segments of the first speech signal via one of a plurality of speech coding modes and a silence description coding mode, wherein the multi-rate coder selects the silence description mode when an absence of a substantially speech-like characteristic is detected in a segment independent of the speech coding mode applied to an earlier segment; and a multi-rate decoder operatively coupled to the multi-rate coder, wherein the multi-rate decoder is capable of receiving and decoding the second plurality of encoded segments, wherein the multi-rate decoder selectively adds comfort noise to the decoded segment.

26. The multi-rate codec of claim 25, further comprising an error checking mechanism that reduces erroneous transmission by transmitting redundant data and performing majority voting on the redundant data.

27. The multi-rate codec of claim 26, wherein the multi-rate codec transmits the redundant data when the first speech signal is being coded with the silence description coding mode.

28. The multi-rate codec of claim 27, wherein the amount of the redundant data transmitted is a function of an available communication bandwidth.

29. The multi-rate codec of claim 28, wherein the multi-rate coder comprises a perceptual weighting filter.

30. The multi-rate codec of claim 25, wherein the multi-rate coder selects a speech coding mode from the plurality of speech coding modes as a function of a power consumption level associated with each speech coding mode.

31. The multi-rate codec of claim 25, wherein the multi-rate coder selects a speech coding mode from the plurality of speech coding modes as a function of a electromagnetic interference level associated with each speech coding mode.

32. The multi-rate codec of claim 25, wherein the multi-rate coder selects a speech coding mode from the plurality of speech coding modes as a function of a radio frequency interference level associated with each speech coding mode.

* * * * *

UNITED STATES PATENT AND TRADEMARK OFFICE

CERTIFICATE OF CORRECTION

PATENT NO. : 7,120,578 B2
APPLICATION NO. : 09/841764
DATED : October 10, 2006
INVENTOR(S) : Thyssen et al.

It is certified that error appears in the above-identified patent and that said Letters Patent is hereby corrected as shown below:

Column 11, line 10, --immediately-- should be inserted after “applied”.

Column 11, line 22, “computer network-based” should be changed to --network--.

Column 11, line 25, “computer network-based” should be changed to --network--.

Column 11, line 26, “an internet-based network” should be change to --a network--.

Column 11, line 28, “computer network-based” should be changed to --network--.

Column 11, lines 29-30, “the internet-based” should be changed to --a--.

Column 11, line 33, “computer network and telephone network” should be changed to --wireless network--.

Column 11, line 35, “telephone network is a cellular telephone network” should be changed to --wireless network includes a communication cell--.

Column 11, lines 40-41, “cellular telephone to a computer” should be changed to --wireless--

Column 11, line 53, --immediately before the second segment-- should be inserted after “speech signal”.

Column 12, lines 7-8, “first segments” should be changed to --first segment--.

Column 12, line 17, “first segments of the speech signal” should be changed to --first segment of the speech signal immediately before the second segment--.

Column 12, lines 19-20, “substantially imperceptible” should be changed to --perceptually indistinguishable--.

Column 12, line 29, “computer” should be changed to --wireless--.

Column 12, line 34, “computer” should be changed to --wireless--.

Column 12, line 37, --second-- should be inserted immediately before “plurality”.

UNITED STATES PATENT AND TRADEMARK OFFICE

CERTIFICATE OF CORRECTION

PATENT NO. : 7,120,578 B2
APPLICATION NO. : 09/841764
DATED : October 10, 2006
INVENTOR(S) : Thyssen et al.

It is certified that error appears in the above-identified patent and that said Letters Patent is hereby corrected as shown below:

Column 12, line 46, --immediately-- should be inserted before "earlier segment".

Signed and Sealed this

Sixteenth Day of January, 2007

JON W. DUDAS
*Director of the United States Patent and Trademark Office*